US006203286B1

(12) United States Patent
Moll et al.

(10) Patent No.: US 6,203,286 B1
(45) Date of Patent: Mar. 20, 2001

(54) ELECTRIC FUEL PUMP WHICH IS SELF-FILLING AT LOW FUEL LEVELS IN A FUEL TANK

(75) Inventors: Gunter Moll, Korschenbroich; Stefan Wolters, Monchengladbach; Stefan Kluth, Neuss, all of (DE)

(73) Assignee: Pierburg AG, Neuss (DE)

( * ) Notice: Subject to any disclaimer, the term of this patent is extended or adjusted under 35 U.S.C. 154(b) by 0 days.

(21) Appl. No.: 09/483,670

(22) Filed: Jan. 14, 2000

(30) Foreign Application Priority Data

Jan. 14, 1999 (DE) ..... 199 01 032

(51) Int. Cl.[7] ..... F04B 49/00

(52) U.S. Cl. ..... 417/279; 123/509; 137/565

(58) Field of Search ..... 137/574, 565, 137/413; 123/514, 509; 417/279, 292; 280/230

(56) References Cited

U.S. PATENT DOCUMENTS

| | | | | |
|---|---|---|---|---|
| 4,503,885 | * | 3/1985 | Hall | 137/574 |
| 4,694,857 | * | 9/1987 | Harris | 137/565 |
| 4,747,388 | * | 5/1988 | Tuckey | 123/514 |
| 4,807,582 | * | 2/1989 | Tuckey | 123/514 |
| 5,029,611 | * | 7/1991 | Sasaki | 137/574 |
| 5,110,265 | * | 5/1992 | Kato et al. | 417/279 |
| 5,398,659 | * | 3/1995 | Zimmerman et al. | 123/514 |
| 5,415,146 | * | 5/1995 | Tuckey | 123/509 |
| 5,452,701 | * | 9/1995 | Tuckey | 123/509 |
| 5,560,342 | * | 10/1996 | Fournier et al. | 123/509 |
| 5,647,328 | * | 7/1997 | Fournier et al. | 123/509 |
| 5,655,892 | * | 8/1997 | Cherniawski et al. | 417/292 |
| 5,809,975 | * | 9/1998 | Tuckey et al. | 123/509 |
| 5,951,050 | * | 9/1999 | Siekmann | 280/830 |
| 5,960,775 | * | 10/1999 | Tuckey | 123/509 |
| 5,979,485 | * | 11/1999 | Tuckey et al. | 137/413 |
| 6,098,600 | * | 8/2000 | Umetsu et al. | 123/514 |

FOREIGN PATENT DOCUMENTS

| | | | |
|---|---|---|---|
| 3540260 | | 5/1987 | (DE) . |
| 4038875 | | 3/1992 | (DE) . |
| 4333969A1 | * | 4/1995 | (DE) . |
| 4409032 | | 9/1995 | (DE) . |
| 19616493A1 | * | 11/1996 | (DE) . |
| 19618452 | | 11/1997 | (DE) . |

* cited by examiner

*Primary Examiner*—Teresa Walberg
*Assistant Examiner*—Leonid Fastovsky
(74) *Attorney, Agent, or Firm*—Ladas & Parry

(57) ABSTRACT

An electric fuel pump mountable in a fuel tank for pumping fuel to an internal combustion engine. A casing of the fuel pump is mountable at a bottom wall of the fuel tank and has a fuel inlet at a lower end and a fuel outlet at an upper end so that the fuel is pumped upwardly through the casing. A vent valve is disposed at the top of the casing and is closed when the fuel pump is operating and opened when the fuel pump is deactivated. A conduit has one end connected to the vent valve and an opposite end which is open and located at a level in proximity to the bottom of the fuel tank so that when the fuel pump is deactivated the conduit serves as a suction passage to fill the casing when the fuel level in the fuel tank drops below the top of the casing to enable restarting of the engine without delay.

11 Claims, 1 Drawing Sheet

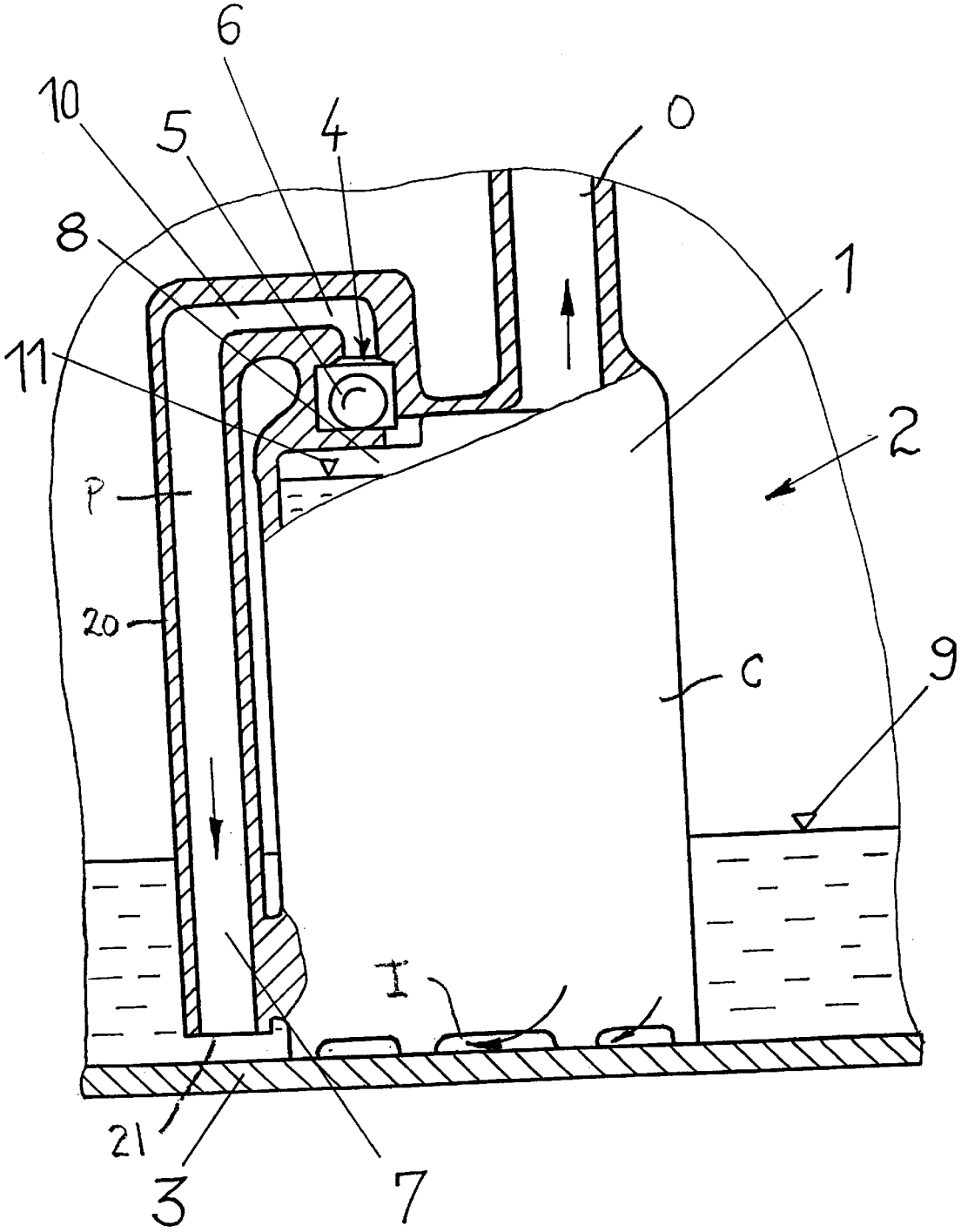
6
10
5
4
0
8
1
11
2
P
20
C
9
I
21
3
7

ELECTRIC FUEL PUMP WHICH IS SELF-FILLING AT LOW FUEL LEVELS IN A FUEL TANK

FIELD OF THE INVENTION

The invention relates to an electric fuel pump for an internal combustion engine in which the fuel pump is adapted for being mounted at the bottom of a fuel tank for pumping the fuel from a lower inlet to an upper outlet of the pump and wherein a vent valve is mounted at the top of the pump for being opened when the pump is deactivated.

The invention also relates to a method of operation of the fuel pump.

BACKGROUND AND PRIOR ART

A pump of the above type is disclosed in DE 196 18 452 A1. This fuel pump operates satisfactorily when the fuel tank is full but when the tank is almost empty and the fuel level drops below the outlet of the vent valve, a temporary delay in pumping the fuel takes place when the fuel pump is reactivated. This is due to the emptying of the chamber in the casing of the fuel pump when the pump is deactivated until the pump is once again filled after it has been reactivated. This can lead to problems in starting the internal combustion engine.

SUMMARY OF THE INVENTION

An object of the invention is to provide means by which the internal combustion engine can be rapidly restarted even when the fuel tank is almost empty.

A particular object of the invention is to provide means by which the fuel pump is self-filling even when the fuel tank is almost empty.

A further object of the invention is to provide a method which prevents emptying of the fuel in the fuel pump when the fuel pump is deactivated and particularly to fill the fuel pump through the open vent valve via a suction passage connected thereto when the fuel pump is deactivated and the level of the fuel in the fuel tank drops below the outlet of the vent valve.

The invention provides an electric fuel pump mountable in a fuel tank for pumping fuel to an internal combustion engine. The fuel pump comprises a casing mountable at a bottom wall of the fuel tank, the casing having a fuel inlet at a bottom thereof and a fuel outlet at a top thereof so that the fuel pump pumps fuel upwardly through the casing from the inlet to the outlet. A vent valve is provided at the top of the casing and the vent valve is closed when the fuel pump is operating and is opened when the fuel pump is deactivated. A conduit defining a passage has one end connected to an outlet of the vent valve and an opposite end which is open at a level in proximity to the bottom of the fuel tank so that when the fuel pump is deactivated, fuel will substantially fill the casing of the pump to facilitate pumping of the fuel when the pump is reactivated.

In further accordance with the invention, the passage extends upwardly from the vent valve to a bend portion and then extends downwardly to the opposite open end.

The invention also provides a method of preventing emptying of fuel in a fuel pump when the fuel pump is deactivated by suctioning fuel from the fuel tank through said passage into the fuel pump so that the fuel pump can immediately start pumping of fuel when the fuel pump is reactivated.

BRIEF DESCRIPTION OF THE DRAWING

The sole FIGURE of the drawing is a sectional view partly broken away showing an embodiment of a fuel pump according to the present invention.

DETAILED DESCRIPTION OF THE PREFERRED EMBODIMENT

Referring to the drawing, therein is shown an electric fuel pump 1 which is mounted at the bottom 3 of a fuel tank 2 of an internal combustion engine (not shown). The fuel pump can be mounted directly on the bottom of the fuel tank as shown or it can be installed in a so-called "Schinger pot" on the bottom of the tank. The fuel pump comprises a casing C having an inlet I at the bottom for entry of fuel thereat in the direction of the arrows and an outlet O connected to the internal combustion engine for supplying pumped fuel thereto in the direction of the arrow. The fuel travels through the casing C from the bottom to the top in an upwards direction. A vent valve 4 is mounted at the top of the fuel pump. The vent valve 4 is normally closed during the fuel pumping operation and when the pump is deactivated the valve 4 is opened to vent chamber 8 in the casing. This operation is conventional. The vent valve 4 is formed as a ball valve 5 but could have other constructions as well known in the art.

A conduit 20 forms a passage P having an inlet end 6 connected to the outlet of the vent valve 4 and an opposite lower end 21 which is open in the fuel tank and is located in facing relation with the bottom 3 of the fuel tank in immediate proximity thereto at about the level of the inlet I of the casing. The outlet 21 extends below the level 9 of the fuel in the fuel tank. Hence, when the fuel pump is deactivated, the conduit 20 prevents the casing of the fuel pump from emptying as would be the case in the prior art construction which would prevent rapid restarting of the fuel pump until it is once again filled with fuel. Furthermore, in the prior art construction this can also lead to inability to restart the internal combustion engine.

However, by virtue of the conduit 20 and the immersion of the open end 21 of the passage P below the level of the fuel in the fuel tank, fuel is suctioned in the conduit 20 into the chamber 8 in the fuel pump via passage P when fuel level 11 in the chamber sinks until an equilibrium is reached and the fuel level 11 in the fuel pump is maintained substantially full. Accordingly, the passage P forms a suction passage extending from the lower end 21 to a bend portion 10 and then to a downwards portion 6 communicating with the outlet of vent valve 4 to provide a self-filling of the fuel pump when it is deactivated so that when the fuel pump is restarted, it operates without delay.

The conduit 20 is integrally formed with the casing C of the fuel pump and forms a tubular portion extending parallel to the casing which is connected at its lower end to the casing adjacent to the open end 21. At its upper end, the conduit 20 extends above the casing to form the bend portion 10 which connects to the outlet of the vent valve 4.

While the invention has been disclosed in relation to a specific embodiment thereof, it will become apparent to those skilled in the art that numerous modifications and variations can be made within the scope and spirit of the invention as defined in the attached claims.

What is claimed is:

1. An electric fuel pump mountable in a fuel tank for pumping fuel to an internal combustion engine, said fuel pump comprising a casing mountable at a bottom wall of the fuel tank, said casing having a fuel inlet at a bottom thereof and a fuel outlet at a top thereof so that the fuel pump can pump fuel upwardly through the casing from said inlet to said outlet, a vent valve at the top of the casing which is closed when the fuel pump is operating to pump fuel and is opened when the fuel pump is deactivated, and a conduit defining a passage having one end connected to said vent valve and an opposite end which is open at a level in proximity to the bottom of the fuel tank so that when the fuel pump is deactivated fuel will be suctioned in said passage to said casing of the pump to facilitate pumping of the fuel when the pump is reactivated.

2. An electric fuel pump as claimed in claim 1, wherein said opposite open end of the passage is substantially at the level of the inlet of the casing.

3. An electric fuel pump as claimed in claim 1, wherein said passage extends upwardly from the vent valve to a bend portion and then downwardly to said opposite open end.

4. An electric fuel pump as claimed in claim 3, wherein said conduit is integrally formed with said casing.

5. An electric fuel pump as claimed in claim 4, wherein said conduit includes a tubular portion extending adjacent to said casing, said opposite end of said passage being located at a lower end of said conduit.

6. An electric fuel pump as claimed in claim 5, wherein said conduit extends above said top of the casing and includes said bend portion therein.

7. An electric fuel pump as claimed in claim 6, wherein said tubular portion of the conduit extends parallel to said casing.

8. An electric fuel pump as claimed in claim 7, wherein said conduit is secured to said casing in proximity to said open end of said passage.

9. An electric fuel pump as claimed in claim 8, wherein said open end of said passage faces said bottom of the fuel tank when the fuel pump is mounted thereat.

10. A method of preventing emptying of fuel in a fuel pump when the fuel pump is deactivated and a vent valve is opened, the fuel pump being mounted at the bottom of a fuel tank and pumping fuel upwardly from a fuel inlet at the bottom of the fuel pump to an outlet at the top of the fuel pump, the vent valve being located at the top of the fuel pump and being opened when the fuel pump is deactivated, said method comprising providing a suction passage connecting the vent valve to an outlet opening at an end of the suction passage which is located in proximity to said bottom of the fuel tank so that when the fuel pump is deactivated and the vent valve is opened, fuel is suctioned from the fuel tank through said passage into the fuel pump to facilitate pumping of fuel when the fuel pump is reactivated.

11. A method as claimed in claim 10, comprising forming said suction passage with a bend having one downward portion communicating with the vent valve and a second downward portion at the lower end of which said outlet opening is formed.

* * * * *